US005137478A

United States Patent [19]

Graf et al.

[11] Patent Number: 5,137,478

[45] Date of Patent: Aug. 11, 1992

[54] SEALED SOLDER WIRE CONNECTOR ASSEMBLY AND METHOD OF USE

[75] Inventors: Albert C. Graf; Susan F. Graf, both of Pensacola, Fla.

[73] Assignee: National Standard Parts, Inc., Pensacola, Fla.

[21] Appl. No.: 678,657

[22] Filed: Apr. 1, 1991

[51] Int. Cl.[5] ..... H01R 4/02

[52] U.S. Cl. ..... 439/874; 174/84 R; 174/DIG. 8; 439/932

[58] Field of Search ..... 439/874, 932, 730, 371; 174/84 R, 84 C, DIG. 8

[56] References Cited

U.S. PATENT DOCUMENTS

| | | | |
|---|---|---|---|
| 3,316,343 | 4/1967 | Sherlock . | |
| 3,541,495 | 11/1970 | Ellis et al. | 439/932 |
| 4,781,606 | 11/1988 | Clabburn | 439/161 |
| 4,790,067 | 12/1988 | Grindle | 29/859 |
| 4,883,925 | 11/1989 | Graf | 29/859 |
| 4,894,030 | 1/1990 | Chavaroux | 439/932 |
| 4,993,149 | 2/1991 | Zilligen et al. | 29/859 |

*Primary Examiner*—David L. Pirlot
*Attorney, Agent, or Firm*—Phillip A. Rein

[57] ABSTRACT

This invention relates to a sealed solder wire connector assembly and method of use operable to connect to an electrical wire member. The sealed solder wire connector assembly includes 1) an electrical terminal member having a solder connector end section on one end of a main terminal body; and 2) a protective sleeve asesmbly mounted about the electrical terminal member and constructed of a heat shrink material with an adhesive coating on an inner surface thereof. The solder connector end section is of a semi-circular shape with a low temperature melt solder coating to receive the wire member thereagainst. Application of heat to the sealed solder connector assembly results in 1) melting of the solder coating into the wire member; 2) melting of the adhesive coating; 3) shrinking of the protective sleeve assembly about the wire member and the electrical terminal member; and 4) removing the heat to achieve an air tight fluid sealed solder wire connector assembly.

9 Claims, 1 Drawing Sheet

SEALED SOLDER WIRE CONNECTOR ASSEMBLY AND METHOD OF USE

PRIOR ART

A patent search was not conducted on this particular invention as the inventors herein are knowledgeable in regard to structures presently manufactured and sold in this field as a co-inventor has obtained a U.S. Pat. No. 4,883,925, issued Nov. 28, 1989, entitled "Sealed Solder Connector Assembly and Method of Use". In this patent, the following United States patents of interest were cited:

| Inventor | U.S. Pat. No. | Issued |
|---|---|---|
| Sherlock | 3,316,343 | 4/1967 |
| Wetmore | 3,396,460 | 8/1968 |
| Barthell | 3,582,457 | 6/1971 |
| Grevel, Jr. et al | 3,957,382 | 5/1976 |
| Ellis | 4,151,364 | 4/1979 |
| Dones et al | 4,504,699 | 3/1985 |
| Wallace, Jr. | 4,586,971 | 5/1986 |
| Koblitz | 4,595,724 | 6/1986 |
| Vidakovits | 4,696,841 | 9/1987 |

PREFERRED EMBODIMENT OF THE INVENTION

In one preferred embodiment of this invention, a sealed solder wire connector assembly is provided which is operable to be readily attached to a cable or wire member having copper wire therein enclosed by an outer insulation cover. The sealed solder wire connector assembly includes 1) an electrical terminal member; and 2) a protective sleeve assembly mounted about the electrical terminal member.

The electrical terminal member is provided with a main terminal body having a connector end section at one end thereof and a solder connector end section at an opposite end thereof. The connector end section can be produced in a ring or spade section and is generally usable for connection through an electrical screw to complete an electrical connection to a terminal block or circuit board.

The solder connector end section is provided with a generally semi-circular solder receptacle portion having a solder coating or layer mounted on an inner surface thereof. The solder receptacle portion is of a size to receive and support copper wire strands or solid copper wire on the solder coating or layer while heat is applied thereto.

The protective sleeve assembly includes a main sleeve body integral with a terminal connector section preferrably constructed of a heat shrink plastic material with an inner adhesive layer.

The terminal connector section is provided with a stepped portion which is operable clamp onto a portion of the connector end section of the electrical terminal member when a limited amount of heat has been applied to subject stepped portion.

The inner adhesive layer is operable on application of heat to melt and freely flow into engagement with the electrical terminal member and the wire member. Conjointly, the protective sleeve assembly shrinks about the adjacent portions of the cable wire member and the electrical terminal member on the application of heat to provide the new and novel sealed solder wire connector assembly of this invention.

The method of use of this invention involves 1) stripping the outer cover insulation from the wire member to expose a solder receptive material; 2) inserting the wire member into an inlet opening in the main sleeve body; 3) placing the wire member on the solder receptacle portion of the solder connector end section of the electrical terminal member; 4) applying heat to an outer surface of the sealed solder wire connector assembly and, more specifically, the protective sleeve assembly to provide heat thereon; 5) concurrently shrinking the protective sleeve assembly; melting the inner adhesive layer; and melting the solder coating or layer; and 6) removing the application of heat from the sealed solder wire connector assembly. The protective sleeve assembly shrinks into an air tight connection about the interconnected electrical terminal member and the wire member. Concurrently, a solid solder connection is achieved between the wire member and the solder connector end section of the electrical terminal member.

OBJECTS OF THE INVENTION

One object of this invention is to provide a sealed solder wire connector assembly operable to be connected to a cable or wire member through the application of heat in order to melt a low temperature solder and to shrink a plastic sleeve assembly thereabout to achieve a new, novel, unusual, and firm connection with a minimum amount of expense, time, and skill required.

Another object of this invention is to provide a sealed solder wire connector assembly including an electrical terminal member having a protective sleeve assembly thereabout with the electrical terminal member to receive a wire member supported thereon and, on application of heat to the protective sleeve assembly, it encloses the wire member to achieve an air tight sealed connection.

One other object of this invention is to provide a sealed solder wire connector assembly including an electrical terminal member partially enclosed in a protective sleeve assembly and having a wire member mounted on the electrical terminal member whereupon the application of external heat causes the method steps of 1) causing a solder coating on a solder receptacle portion of the electrical terminal member to melt and integrate with the wire member; 2) melting of an adhesive layer on an inner surface of the protective sleeve assembly about the wire member and the electrical terminal member; and 3) shrinking the protective sleeve assembly about portions of the electrical terminal member and the wire member to achieve a sealed soldered electrical connection therewith.

One further object of this invention is to provide a sealed solder wire connector assembly for anchoring a wire member through a soldered connection requiring a minumum heat source and skill required to achieve a new, novel, economical, and sealed electrical connection.

Still, one other object of this invention is to provide a sealed solder wire connector assembly for attaching to an electrical wire member through flux soldering techniques without requiring skilled labor; the necessity of tools except an inexpensive heat source and clamp member; and being economical to manufacture; easy to assemble; and substantially maintenance free.

Various other objects, advantages, and features of the invention will become apparent to those skilled in the art from the following discussion, taken in conjunction with the accompanying drawings, in which:

FIGURES OF THE INVENTION

Figures 1, 2, 3, 4, 5, 6:
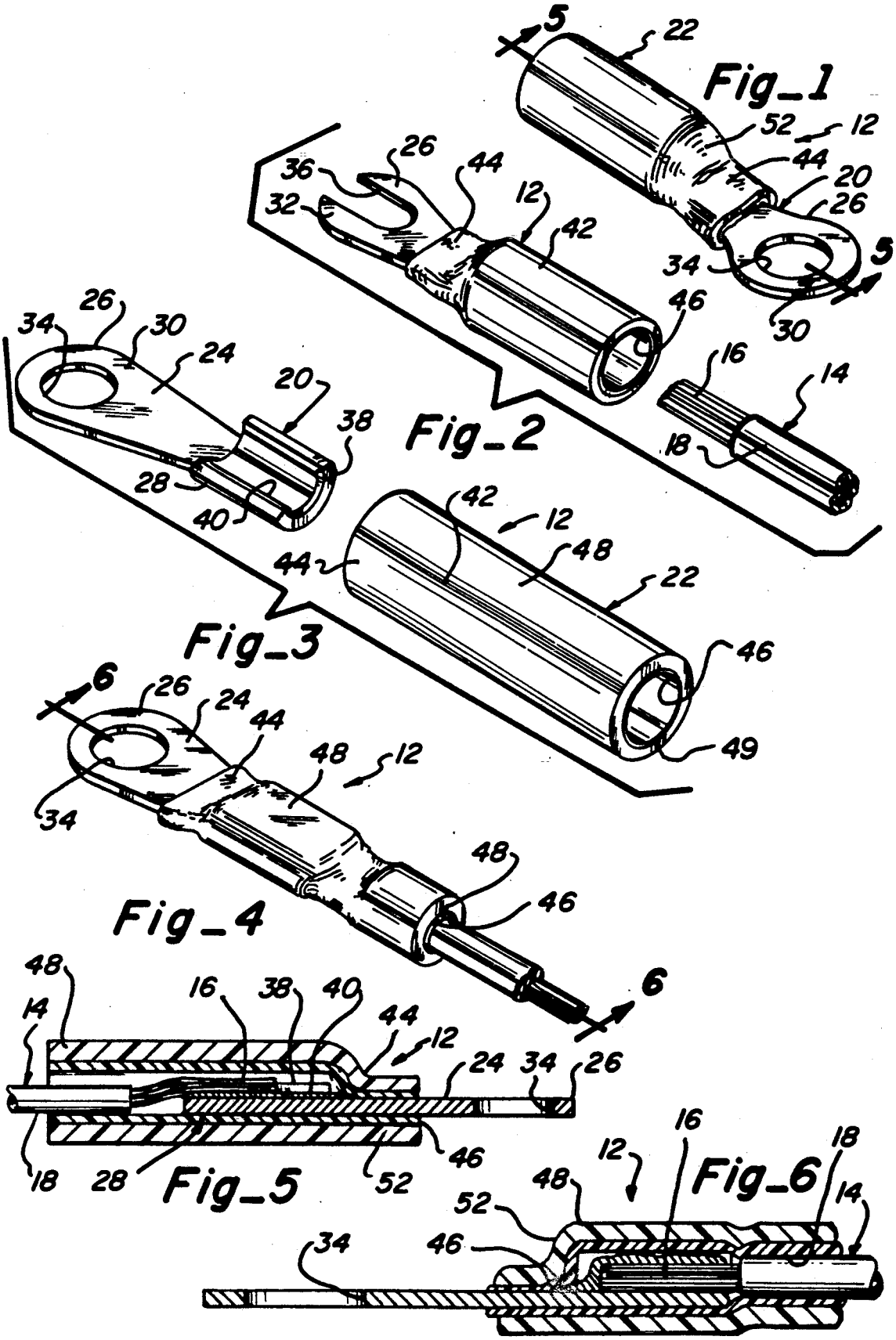
FIG. 1 is a perspective view of a sealed solder wire connector assembly of this invention.
FIG. 2 is an exploded perspective view of the sealed solder wire connector assembly illustrating an end portion of a wire member to be connected thereto.
FIG. 3 is an exploded perspective view of the sealed solder wire connector assembly being assembled illustrating a protective sleeve assembly about an electrical terminal member.
FIG. 4 is a perspective view of the sealed solder wire connector assembly secured to the wire member after the application of external heat thereto.
FIG. 5 is an enlarged sectional view taken along line 5—5 in FIG. 1.
FIG. 6 is a sectional view taken along line 6—6 in FIG. 4.

The following is a discussion and description of preferred specific embodiments of the sealed solder wire connector assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, a sealed solder connector assembly of this invention, indicated generally at 12, is operable to receive a cable or wire member 14 mounted therein for a sealed soldering purpose and function.

The wire member 14 consists of a copper wire strand (or solid copper core) 16 having a portion of an outer insulation cover 18 stripped therefrom to achieve the appearance as noted in FIG. 2. The sealed solder wire connector assembly 12 can be provided in various sizes so as to be compatible with the size of the wire member 14 to be used therewith in a method of usage as will be explained.

The sealed solder wire connector assembly 12 includes an electrical terminal member 20 and a protective sleeve assembly 22 mounted thereabout.

The electrical terminal member 20 includes 1) a main terminal body 24; 2) a connector end section 26 integral with one end of the main terminal body 24; and 3) a solder connector end section 28 integral with an opposite end of the main terminal body 24.

The main terminal body 24 is preferrably constructed of sheet type of aluminum, copper, or other solder conducive material on which a solder material will adhere thereon for reasons to become obvious.

The connector end section 26 is provided in two (2) embodiments being either a ring type connector as noted in FIG. 1 or a spade type connector as noted in FIG. 2. More particularly, the connector end section 26 includes either a ring section 30 or a spade section 32.

The ring section 30 is provided with a hole 34 to receive an anchor member such as an electrical screw therethrough for attaching to an electrical terminal board, block, or the like.

The spade section 32 is provided with a slot portion 36 of U-shape so that it can be mounted about and an electrical screw which has been loosened on a terminal board. After sliding the U-shaped slot portion 36 about the electrical screw, it is tightened to clamp the spade section between an inner surface of the electrical screw and a terminal block in a conventional manner.

The solder connector end section 28 is provided with a semi-circular shaped solder receptacle portion 38 having a solder coating or layer 40 secured thereto as noted in FIG. 3. The semi-circular shape of the solder receptacle portion 38 in conjunction with the solder coating or layer 40 is operable to be compatible with a similar outer diameter of the wire member 16. It is obvious that the larger size of cable or wire member 14 being utilized would require a greater compatible size of the electrical terminal member 20 and the protective cover sleeve 22 to achieve the end product of this invention as noted in FIG. 4.

A preferred embodiment has the solder coating or layer 40 constructed of a comosition material of 50 percent tin; 32 percent lead; and 18 percent cadmium or bismuth which has a melting temperature of 291 degrees Fahrenheit.

As noted in FIG. 3, the protective sleeve assembly 22 is provided with a main sleeve body 42 of generally cylindrical shape having an outer terminal connector portion 44.

The protective sleeve assembly 22 is constructed of a flexible plastic tube preferrably being a heat-shrinkable product manufactured by ECC-3M, a division of 3M, and marketed under the trademark "Insultite". More particularly, the main sleeve body 42 is constructed of a multiple wall polyolefin material having the following characteristics being 1) shrinks on the application of heat with at minimum of 275 degrees Fahrenheit temperature; 2) acceptable operating temperature range is minus 67 degrees Fahrenheit to 230 degrees Fahrenheit; 3) has a shrink ratio of 2.5:1; and 4) non-corrosive, highly resistant to moisture absorbtion and non-electrical conductive.

The main sleeve body 42 is provided with an inner adhesive layer 46 secured against an inner surface of an outer heat shirnk layer 48. The inner adhesive layer 46 is of a known adhesive type material that, on application of heat thereto, will flow about adjacent portions of the electrical terminal member 20 and the wire member 14. On removal of the heat from the adhesive layer 46, it will bond and seal with adjacent contacting elements.

The adhesive layer 46 is preferrably constructed of an ethylene-ethyl-acrylate material known as EEA a characteristic of being in a solid state at room temperatures. However, on heating the protective sleeve assembly 22 in a manner to be explained, the adhesive layer 46 is transformed into a fluid adhesive material which bonds to the adjacent portion of the protective sleeve assembly 22, the wire member 14, and additionally, to the insulation cover 18 and the electrical terminal member 20. The adhesive layer 46 becomes fluid and adhesive at temperatures below the 291 degree Fahrenheit temperature which is applied to the outer surface of the protective sleeve assembly 22 to achieve shrinkage thereof as will be explained.

The outer heat shrink layer 48 is constructed of a heat shrink plastic type material which, on application of heat thereto, would shrink from a generally cylindrical shape as noted in FIG. 3 to a compact sealed condition as noted in FIGS. 4 and 6 through the method steps of this invention.

The terminal connector section 44 is formed during assembly into a stepped portion 52 when limited heat is applied to one end of the main sleeve body 42 to achieve the manufactured sealed solder wire connector assembly 12 as noted in FIG. 1.

The actual solder coating or layer 40 can be formed with a flux material mixed therein being of a type that adheres to an adjacent portion of the solder receptacle portion 48 of the electrical terminal member 20. The flux material is preferrably a mildly activated rosin material being a 2.0 or 3.0 percent composition mixed with the solder coating or layer 40.

The solder coating or layer 40 and combination flux material is of a low temperature melt composition so that it will melt, flow, and solder with the wire member 14 in conjunction with melting of the inner adhesive layer 46 and shrinking of the outer heat shrink layer 48 to achieve the new and novel sealed solder electrical connection 12 of this invention as will be explained.

USE AND OPERATION OF THE INVENTION

In the use and operation of the sealed solder wire connector assembly 12 of this invention, it is noted that the electrical terminal member 20 is chosen with either the connector end section 26 having the ring section 30 or the spade section 32 used therewith. This is the only difference in the embodiments of the sealed solder wire connector assembly 12.

On placing the protective sleeve assembly 22 about the solder connector end section 28 of the electrical terminal member 20, a limited heat source such as a flame from a butane torch is applied to one end portion of the main sleeve body 42 to cause a shrinkage and create the stepped portion 52 as noted in FIGS. 1 and 2. This is the form in which the sealed solder wire connector assembly 12 of this invention would be sold in kit form with various sizes being color coded to indicate the specific size of the wire member 14 to be used with respective ones of the sealed solder wire connector assemblies 12.

The first step in the method of use of this invention is to obtain the wire member 14 from which approximately ½ inch of an outer end of the wire member 14 is stripped to reveal the copper wire strands or core 16 as noted in FIG. 2.

Next, the wire member 14 is moved axially through an inlet opening 49 to place the copper wire strands or core 16 on the upper solder coating or layer 40 of the solder receptacle portion 38 as noted in FIG. 5. The ring section 30 or the spade section 36 is then best held against movement in a vise or clamp member.

On applying the heat from, for example, a torch member to the electrical terminal member 20, the heat is transferred rearwardly on the conductive metal portion to the solder coating or layer 40 on the solder receptacle portion 38. This causes a heating of the solder coating or layer 40 so as to impregnate the copper wire strands or core 16 of the wire member 14 mounted thereon.

Concurrently, heat is applied by the torch member to the protective sleeve assembly 22 and would melt the inner adhesive layer 46 about adjacent portions of the copper wire strands or core 16 and the connector end section 26 of the electrical terminal member 20. This heat is cautiously applied to prevent excessive melting or charring of the outer heat shrink layer 48 of the protective sleeve assembly 22.

After the heat is removed, the adhesive layer 46 and solder coating or layer 40 solidifies, the protective sleeve assembly 22 shrinks and solidifies, and the end product as noted in FIG. 6 is achieved.

The outer heat shrink layer 48 contracts to completely enclose and cooperate with the inner adhesive layer 46 to provide an air tight, sealed solder connection impervious to weather conditions, air and fluid corrosion, contaminations, and the like while providing a very strong interconnection between the wire member 14 and the electrical terminal member 20.

It is noted that the sealed solder wire connector assembly 12 of this invention is operable for interconnection to a wire member 14 through a sealed solder connection but does not require expensive tools or great skill to achieve subject end result. It has been previously necessary in the prior art to utilize a roll of solder wire, a torch member, a flux material, plus requiring fixtures to hold a copper wire on a terminal member to be soldered. Then, additional steps are necessary to achieve a soldered electrical connection to achieve an air tight protective cover thereabout.

The sealed solder wire connector assembly of this invention is readily operable without the use of skilled labor or expensive tools; provides a sealed waterproof solder connection having an outer plastic heat shrink layer mounted thereabout; economical to manufacture; and substantially maintenance free.

While the invention has been described in conjunction with preferred specific embodiments thereof, it will be understood this description is intended to illustrate and not to limit the scope of the invention, which is defined by the following claims:

We claim:

1. A sealed solder connector assembly operable to receive an electrical wire member for connection thereto, comprising:

a) an electrical terminal member including a main terminal body, a connector end section integral with one end of said main terminal body operable for electrical connection to an external member, and a solder connector end section integral with another opposed end of said main terminal body;

b) said solder connector end section includes a semi-circular shaped solder receptacle portion having a solder layer to receive the wire member thereon for connection thereto; and c) a protective sleeve assembly of a heat-shrinkable material mounted about said main terminal body and said solder connector end section;

whereby the application of heat about an exterior surface of said protective sleeve assembly causes same to shrink into an air tight fit over said main terminal body, said solder connector end section, and the wire member enclosed thereby and said solder layer first melts, fuses with the wire member, and then cools to form a solid, soldered electrical connection.

2. A sealed solder wire connector assembly connectable to an exposed electrical conductor wire found in an electrical wire member, comprising:

a) a protective sleeve assembly constructed of heat-shrinkable tubing material of a size to receive the wire member;

b) an electrical terminal member including a main terminal body having a solder connector end section;

c) said solder connector end section of semi-circular shape in transverse cross section having a solder layer on an inner concave surface to receive, support, and contact an outer surface of the conductor wire; and d) said protective sleeve assembly mounted about said solder connector end section;

whereby the application of heat about an exterior of said protective sleeve assembly shrinks same about said electrical terminal member and the wire member to achieve an air tight electrical connection.

3. A sealed solder wire connector assembly as described in claim 2, wherein:

a) said protective sleeve assembly shrinks at a heat temperature lower than said melt temperature to force said solder layer to comingle and fuse the wire member against said solder connector end section under compression force.

4. A sealed solder wire connector assembly as described in claim 3, wherein:

a) said melt temperature is 291 degrees Fahrenheit.

5. A sealed solder wire connector assembly as described in claim 4, wherein:

a) said heat temperature is 275 degrees Fahrenheit.

6. An air tight, sealed solder connection using a sealed solder wire connector assembly to anchor and seal an electrical wire member thereto having a central wire section exposed from an insulation cover member, comprising:

a) said sealed solder wire connector assembly having an electrical terminal member and a protective sleeve assembly mounted about and connected to a portion of said electrical terminal member;

b) said electrical terminal member includes a connector end section operable to be connected to an external member, a main terminal body integral at one end to said connector end section, and a solder connector end section integral with another end of said main terminal body;

c) said solder connector end section of U-shape in transverse cross section having a solder layer on an inner surface;

d) said protective sleeve assembly shrinks about the wire member, said solder connector end section, and the insulation cover member to form a vapor seal therewith; and e) the central wire section fuses with said solder layer on said solder connector end section to form a rigid solid electrical connection similar to a conventional electrical wire solder joint.

7. A method of joining an electrical wire member having an exposed solder conductive end portion and an insulation cover thereabout to a sealed solder wire connector assembly having a main terminal member with a protective sleeve assembly constructed of a heat-shrink material mounted thereabout to achieve a sealed solder connection, the process steps, comprising:

a) inserting the conductive end portion of the wire member into an open end of said protective sleeve assembly and supported on a solder connector end section of semi-circular shape in transverse cross section of said electrical terminal member;

b) applying initial external heat to said protective sleeve assembly causing same to shirnk about said solder connector end section and a wire member; and c) applying additional heat to said protective sleeve assembly to melt solder on said solder connector end section about the wire member and further shrink said protective sleeve assembly to form a sealed, vapor tight connection.

8. A solder assembly method as described in claim 7, wherein:

a) applying said initial external heat at a minimum temperature of 275 degrees Fahrenheit.

9. A solder assembly method as described in claim 7, wherein:

a) applying said additional heat at a minimum temperature of 291 degrees Fahrenheit.

* * * * *